US007134470B2

(12) United States Patent
McCance

(10) Patent No.: US 7,134,470 B2
(45) Date of Patent: Nov. 14, 2006

(54) WINDOW COVERING SUPPORT DEVICE AND METHOD OF USE THEREOF

(76) Inventor: Patrick McCance, 975 Clementstone Dr., Powder Springs, GA (US) 30127

( * ) Notice: Subject to any disclaimer, the term of this patent is extended or adjusted under 35 U.S.C. 154(b) by 229 days.

(21) Appl. No.: 10/868,253

(22) Filed: Jun. 14, 2004

(65) Prior Publication Data

US 2005/0274868 A1 Dec. 15, 2005

(51) Int. Cl.
*E06B 9/30* (2006.01)
*A47H 1/00* (2006.01)
*A47H 1/14* (2006.01)

(52) U.S. Cl. ..... 160/168.1 R; 160/123; 160/902; 248/253

(58) Field of Classification Search ..... 160/38, 160/123, 124, 126, 127, 120, 178.1 R, 89, 160/902, 903; 248/253–256, 262–265, 267–269; 16/94 R See application file for complete search history.

(56) References Cited

U.S. PATENT DOCUMENTS 762,594 A * 6/1904 Micheals ..... 248/216.1
2,474,434 A * 6/1949 Mentz ..... 160/112
2,569,063 A * 9/1951 Koegler et al. ..... 248/264
2,706,100 A * 4/1955 Thomason ..... 248/255
3,847,337 A 11/1974 Patrick et al.
3,889,912 A 6/1975 Ray
4,136,847 A 1/1979 Murray
4,684,095 A 8/1987 Athey
4,824,062 A * 4/1989 Wagner ..... 248/265
4,935,988 A 6/1990 Ford et al.
5,018,626 A * 5/1991 Johnson ..... 211/105.1
5,082,226 A * 1/1992 Mahan ..... 248/265
5,195,570 A * 3/1993 Marocco ..... 160/178.1 R
5,219,013 A 6/1993 Rozon
5,505,418 A * 4/1996 Corcoran ..... 248/254
5,529,273 A * 6/1996 Benthin ..... 248/254
5,765,620 A 6/1998 Coleman
6,382,295 B1 5/2002 Nicholson
6,554,237 B1 4/2003 Weber et al.
2002/0162929 A1 11/2002 Downey et al.
2003/0226646 A1 12/2003 Nien

* cited by examiner

*Primary Examiner*—Hugh B. Thompson, II
*Assistant Examiner*—Candace L. Bradford
(74) *Attorney, Agent, or Firm*—Williamson Intellectual Property Law, LLC; Thomas R. Williamson, III

(57) ABSTRACT

A window cover support device and method of use thereon, wherein the device is non-rotating and comprises a bracket having support members in the form of pairs of upward-facing hooks over which a valance rod or curtain rod may be placed, a box structure for confinement of one end of a miniblind support rod, and also a round or rectangular slotted opening for installation of one end of a shade support rod therein. The bracket is utilized in pairs with a tension rod between same to provide support to the selected window cover or combination of window covers. In furtherance of adhesion to the wall, the present invention incorporates a novel plug-flap device of rubber, or other similar material, suitable for insertion into the end of the tension rod, the plug-flap device providing a large surface area of rubber or similar material under the bracket.

17 Claims, 3 Drawing Sheets

WINDOW COVERING SUPPORT DEVICE AND METHOD OF USE THEREOF

TECHNICAL FIELD

The present invention relates generally to window treatment assemblies and methods, and more specifically to a window covering support device and method of use thereof, wherein the present invention provides a non-rotating tension rod and bracket assembly for supporting a variety of window coverings.

BACKGROUND OF THE INVENTION

Window coverings are available in a variety of forms, including curtains, valances, miniblinds and shades. Each type of window covering is typically positioned differently with respect to a selected window, and each may further require or utilize standard, but different, attachment means and methods for securing same over the window.

Curtains and valances typically utilize a sliding rail device in order to permit horizontal movement and positioning of the curtain or valance with respect to the window. Often, such a sliding rail is generally 'U'-shaped, wherein slots formed in the ends thereof are adapted to attach to wall-mounted, or window frame-mounted, upward facing hook pins, via slots in the ends of the sliding rail.

Miniblinds typically utilize a box mount located within the frame of the window. Often, such box mounts permit the insertion of the integral miniblind support rod therein, followed by retention of same within the box via a securing mechanism.

Shades, similar to miniblinds, typically reside within the confines of the window frame. However, since shades perform a rolling/unrolling action, most shades must be fashioned upon thin integral support rods to facilitate such action. Most support rods are typically inserted into circular and/or slotted retention fixtures that are secured to the window frame.

For proper performance and desired aesthetic results, certain considerations must be evaluated when attaching a support device for a window covering. Most important among such considerations is determining whether the installation is to be permanent or temporary. Where installation is permanent, it is customary and prudent to secure a window covering support via screws, nails or adhesive as described by Weber et al. (U.S. Pat. No. 6,554,237). However, Weber et al. '237 is unsuitable for easily removable, temporary installations, and is limited to attachment of curtain rods.

As such, other suitable securing methods are needed for situations when a temporary installation is desired, such as in college dormitories or in rental apartments, where a resident is typically not permitted to install permanent fixtures. Where a temporary installation is desired, the typical choice for installing curtains is via a tension rod, wherein the rod is extended between the faces of the window frame and secured by spring pressure or interference fit. (Although commonly referred to as "tension" rods, it is noted that such rods in fact operate by compression, typically comprising an inner spring that springfully urges or forces apart two slidably-engaged sections.)

Unfortunately, such assemblies positioned within the window frame do not provide the look of a more formal curtain or valance that extends outwardly a few inches from the wall or beyond the window frame. However, attempts to attach outward extensions to tension rods to install another curtain rod thereon, typically cause a levering action that leads to rotation of the tension rod, thereby causing the curtain and rod retained on the extensions to sag or droop; thus, leaving an unsightly gap above the curtain.

A disadvantage of available curtain rods is that most are limited to supporting curtains or valances only, and do not provide facility for installation of miniblinds and/or shades in conjunction with the curtain and/or valance. Indeed, it is often desirable to have more than one window cover, such as, for exemplary purposes only, a combination of a shade with a curtain drawable thereover.

Various attempts have been made to overcome the aforementioned problems. For instance, Nicholson (U.S. Pat. No. 6,382,295) teaches a bracket that permits conversion between a miniblind and a curtain rod by providing a box bracket for the miniblind, wherein the box bracket has an extension for hanging a curtain rod thereupon. However, the device of Nicholson '295 teaches a device that is not easily removable and does not teach a device that can be utilized to install curtain rods, shades and/or miniblinds.

Downey et al. (U.S. Pat. Appl. No. 2002/0162929) teaches an adapter for insertion into a box bracket, wherein the adapter both secures miniblinds in the traditional manner, but also includes upward-facing hooks for installation of curtains and/or valances. However, the device of Downey et al. '929 requires utilization of existing secured box brackets that are not easily removed, if a user so elects, to return the window area to its original condition.

Athey (U.S. Pat. No. 4,684,095) teaches a combination window shade holder and curtain rod hook adapter that install over a window frame. However, the device of Athey '095 requires access to the rear side of a window frame ledge—a surface typically not accessible in fixed windows.

Murray (U.S. Pat. No. 4,136,847) teaches a combination shade and curtain rod bracket plate that must be mounted via fasteners, such as screws, thereby rendering the device unsuitable for temporary installation.

Rozon (U.S. Pat. No. 5,219,013) teaches a curtain rod device that attaches to the end of an integral blind support rod, thereby permitting the utilization of both valance and other curtains along with the blind. However, the device of Rozon '013 requires an existing and installed blind with access to the ends thereof, and thus, is further unsuitable for application to miniblinds, which are typically held within a window frame, thereby preventing access to the ends of the integral support rod thereof.

Patrick et al. (U.S. Pat. No. 3,847,337) teaches an interference telescoping rod having brackets that can be inserted at the ends of the rod for the support of both valance or other curtains, and for the retention of a shade within the frame of the window. The bracket devices of Patrick et al. '337 typically extend outwardly from the wall, but could be placed against the wall surface, thereby preventing rotation of same. The device of Patrick et al. '337 also selectively includes a rubber backing layer selectively adhesively affixed to the brackets to provide a firm and non-slipping engagement with the wall. However, Patrick et al. '337 does not teach the inclusion of a box bracket for retention of miniblinds, and requires the utilization of a complicated compression unit as part of the interference fit telescoping rod.

Therefore, it is readily apparent that there is a need for a simple window covering support device and method for the temporary installation of curtains, valances, miniblinds and/or shades over a selected window structure.

BRIEF SUMMARY OF THE INVENTION

Briefly described, in a preferred embodiment, the present invention overcomes the above-mentioned disadvantages and meets the recognized need for such a device by providing a window covering support device and method of installation for curtains, valances, miniblinds and/or shades thereon.

According to its major aspects and broadly stated, the present invention in its preferred form is a window covering support device and bracket utilized in constructing the window covering support device, wherein the window covering support device is non-rotating, and is utilized for temporary installation of curtains, valances, miniblinds and/or shades.

More specifically, the present invention is a window covering support device and method of use thereof, wherein the window covering support device comprises a bracket having support members for curtains and/or valances in the form of pairs of upward-facing hooks over which a valance rod or curtain rod may be placed. The bracket also includes a box structure for confinement of one end of a miniblind support rod, and also a round or rectangular slotted opening for installation of one end of a shade support rod. As it is typical for shade rods to be round at one end and rectangular at the other end, the present invention provides one bracket having a round opening and another bracket having a rectangular slotted opening for accommodating such available shade rods.

In use, brackets are paired with a tension rod to provide support and adhesion when the brackets are placed against a wall. In furtherance of this, the present invention incorporates a novel plug-flap of rubber, or other similar material, suitable for insertion into the end of the tension rod. The plug passes through a hole in a bracket, while the larger trailing flap stops further passage and ultimately provides a large surface area of rubber or similar material under the bracket for cushioning and adhesion.

A portion of the bracket rests against a wall outside the frame itself but within the room for providing a stop to prevent rotation of the tension rod. However, the rotation of the tension rod is also prevented, in part, by the presence of the plug-flap.

Accordingly, a feature and advantage of the present invention is its ability to provide for temporary installation of window covers.

Another feature and advantage of the present invention is its ability to be utilized for curtains, valances, miniblinds, shades and/or combinations thereof.

Still another feature and advantage of the present invention is its ability to be formed from metal, wood or plastic to facilitate blending and/or matching of same with window molding or other window treatments.

Yet another feature and advantage of the present invention is its ability to permit interchanging of shades and miniblinds without additional hardware.

Yet still another feature and advantage of the present invention is that the rod-and-bracket assembly provides a non-rotating structure.

These and other features and advantages of the present invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Selected Alternate Embodiments with reference to the accompanying drawing figures, in which like reference numerals denote similar structure and refer to like elements throughout, and in which.

DETAILED DESCRIPTION OF THE PREFERRED AND SELECTED ALTERNATIVE EMBODIMENTS

Figure 1A:
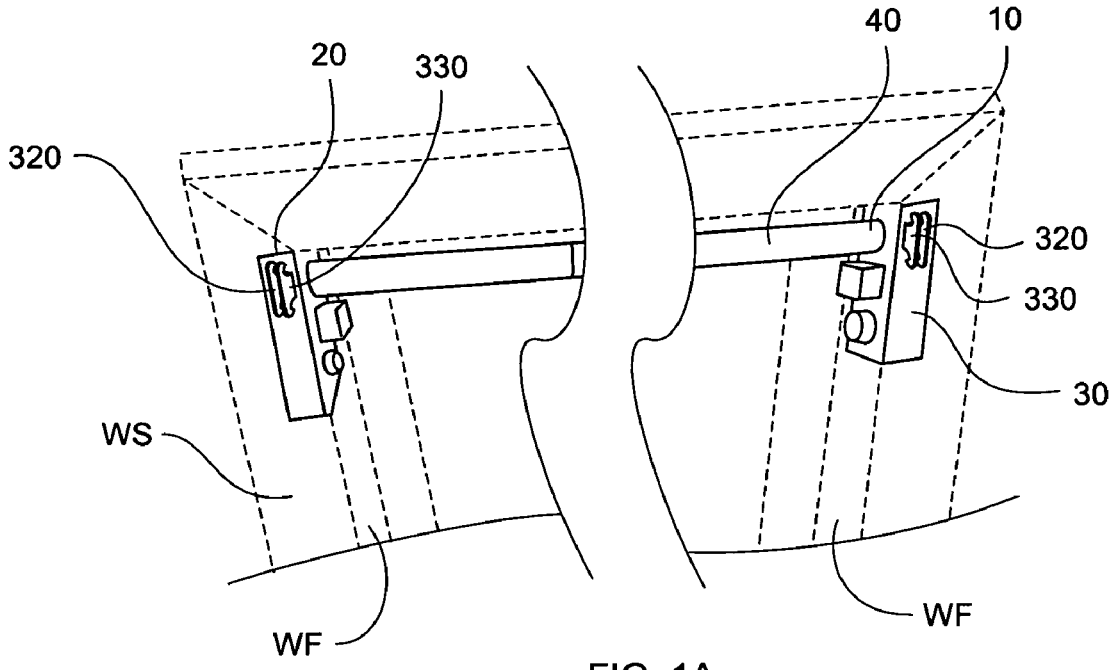
FIG. 1A is a perspective view of a window cover support device according to a preferred embodiment of the present invention.
Figure 1B:
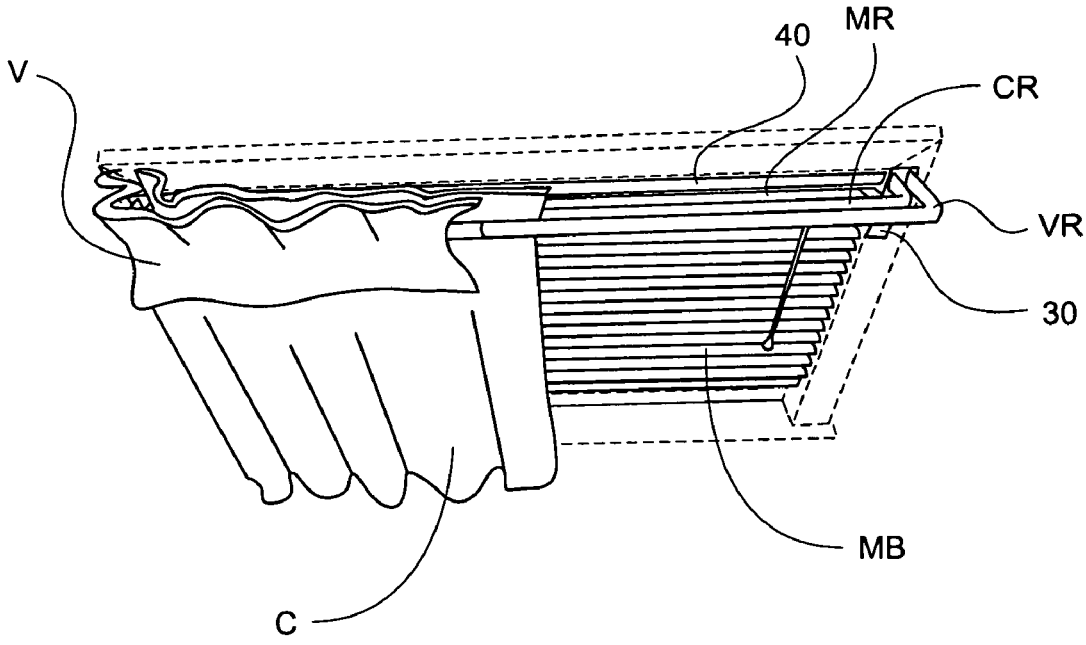
FIG. 1B is a perspective view of a window cover support device according to a preferred embodiment of the present invention, shown with window coverings installed.
Figure 2A:
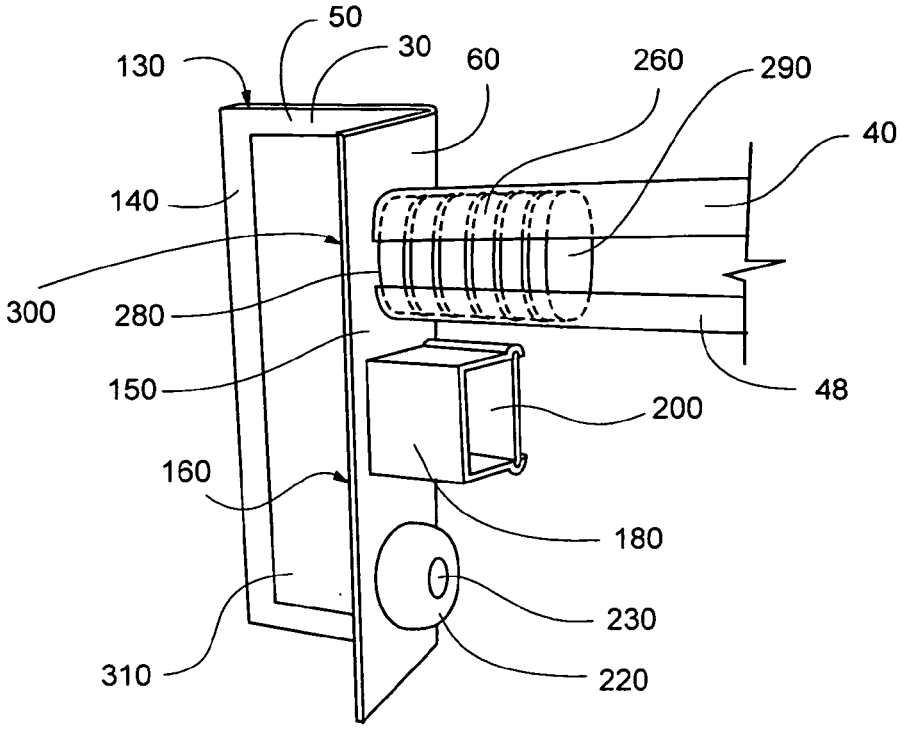
FIG. 2A is a rear perspective view of a right bracket component of a window cover support device according to a preferred embodiment of the present invention.
Figure 2B:
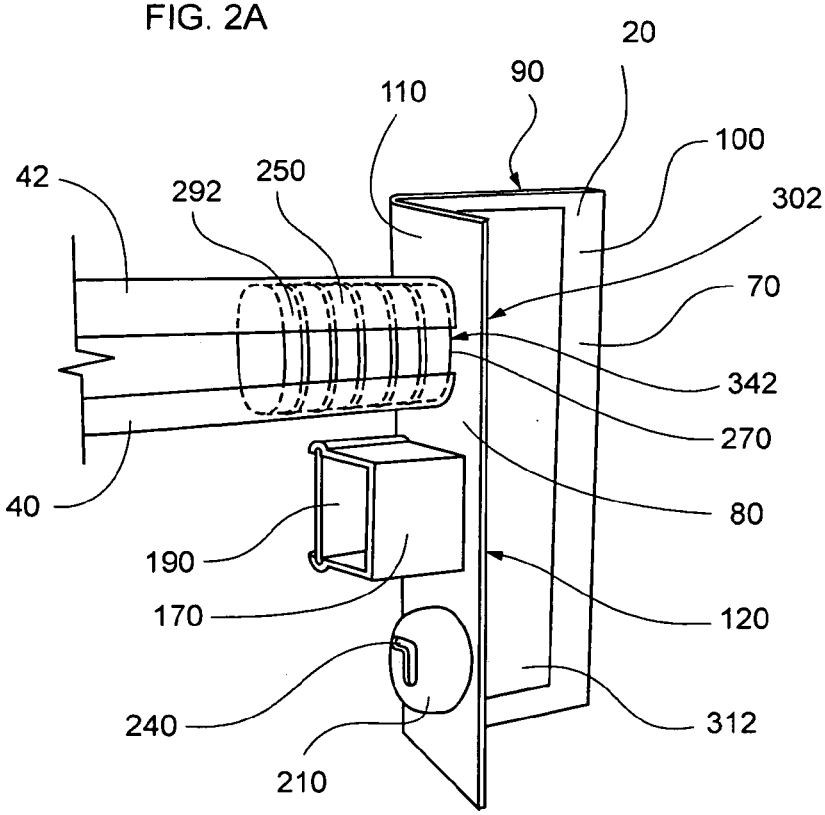
FIG. 2B is a rear perspective view of a left bracket component of a window cover support device according to a preferred embodiment of the present invention.
Figure 2C:
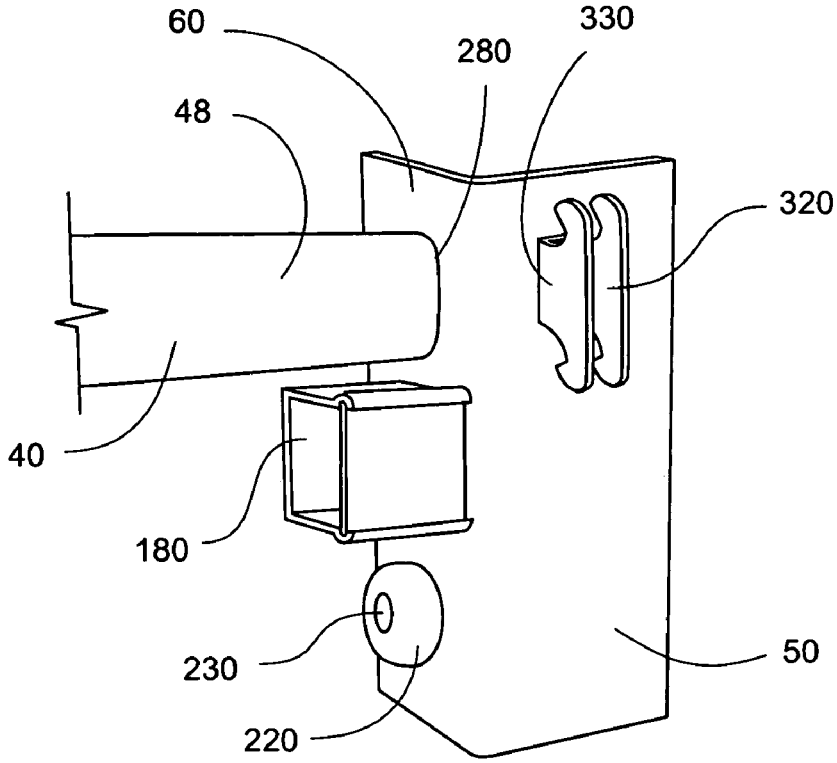
FIG. 2C is a front perspective view of a right bracket component of a window cover support device according to a preferred embodiment of the present invention.
Figure 3A:
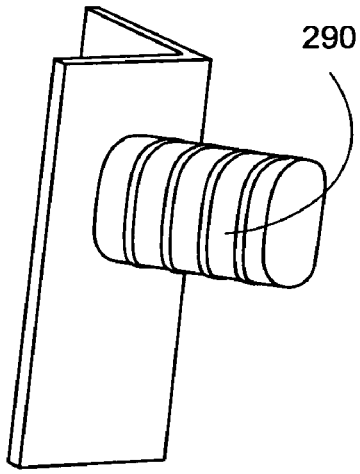
FIG. 3A is a perspective view of a plug component of a window cover support device according to a preferred embodiment of the present invention.
Figure 3B:
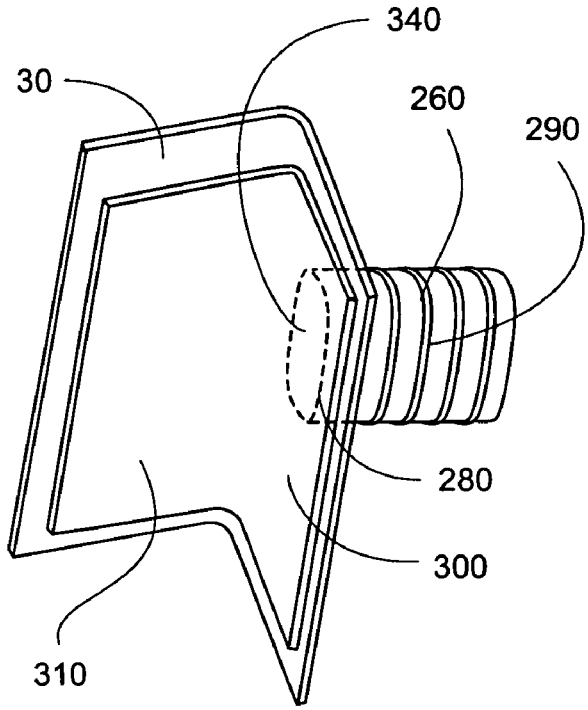
FIG. 3B is a perspective view of a plug component installed in a right bracket component of a window cover support device according to a preferred embodiment of the present invention.

In describing the preferred and selected alternate embodiments of the present invention, as illustrated in FIGS. 1A–3B, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1A–3B, the present invention in a preferred embodiment is window cover support device 10, wherein window cover support device 10 preferably comprises left bracket 20, right bracket 30 and tension rod 40. Left bracket 20 preferably comprises first flange 70 and second flange 80, wherein first flange 70 has first side 90 and second side 100, and wherein second flange 80 has first side 110 and second side 120. Right bracket 30 preferably comprises first flange 50 and second flange 60, wherein first flange 50 has first side 130 and second side 140, and wherein second flange 60 has first side 150 and second side 160.

Left bracket 20 preferably carries inner curtain hook 330 and outer valance hook 320 thereon. Similarly, right bracket 30 preferably carries inner curtain hook 330 and outer valance hook 320 thereon. Inner curtain hooks 330 are preferably adapted to receive curtain rod CR, wherein curtain rod CR is preferably inserted over inner curtain hooks 330 and is retained and supported thereby. Similarly, outer valance hooks 320 are preferably adapted to receive valance rod VR, wherein valance rod VR is preferably inserted over outer valance hooks 320 and is retained and supported thereby.

Left box 170 is preferably carried by first side 110 of second flange 80 of left bracket 20, wherein left box 170 further comprises plate 190. Plate 190 is preferably slidably removable from left box 170 to facilitate entry thereinto of miniblind support rod MR having a generally rectangular shape. Once miniblind support rod MR is installed within and supported by left box 170, plate 190 is preferably reinserted into left box 170, thereby securing miniblind support rod MR therewithin.

Right box 180 is preferably carried by first side 150 of second flange 60 of right bracket 30, wherein right box 180 further comprises plate 200. Plate 200 is preferably slidably removable from right box 180 to facilitate entry thereinto of miniblind support rod MR having a generally rectangular shape. Once miniblind support rod MR is installed within and supported by right box 180, plate 200 is preferably reinserted into right box 180, thereby securing miniblind support rod MR therewithin.

Left button 210 is preferably carried by first side 110 of second flange 80 of left bracket 20, wherein left button 210 preferably further comprises slot 240. Slot 240 is preferably adapted to slidably receive and support rectangular end (not shown) of a conventional shade rod. Right button 220 is preferably carried by first side 150 of second flange 60 of right bracket 30, wherein right button 220 preferably further comprises hole 230. Hole 230 is preferably adapted to receive and support round end (not shown) of a conventional shade rod.

Left bracket 20 preferably further carries left plug 250, wherein left plug 250 further comprises stem 292 and flap 302. Stem 292 of left plug 250 is preferably received by left bracket 20 via throughhole 270, wherein stem 292 of left plug 250 is preferably inserted from second side 120 of second flange 80, passed through throughhole 270 and beyond first side 110 of second flange 80 of left bracket 20. Left plug 250 is preferably restrained from passing completely through throughhole 270 by flap 302. Stem 292 of left plug 250 is preferably subsequently inserted into left end 42 of tension rod 40, thereby securing left end 42 of tension rod 40 on left plug 250.

Right bracket 30 preferably further carries right plug 260, wherein right plug 260 further comprises stem 290 and flap 300. Stem 290 of right plug 260 is preferably received by right bracket 30 via throughhole 280, wherein stem 290 of right plug 260 is preferably inserted from second side 160 of second flange 60, passed through throughhole 280 and beyond first side 150 of second flange 60 of right bracket 30. Right plug 260 is preferably restrained from passing completely through throughhole 280 by flap 300. Stem 290 of right plug 260 is preferably subsequently inserted into right end 48 of tension rod 40, thereby securing right end 48 of tension rod 40 on right plug 260.

Left plug 250 preferably comprises stem 292 and flap 302 and right plug 260, wherein stem 292 and flap 302 are comprised of a resilient, cushioning material having a surface suitable to augment adhesion of brackets 20 and 30 when brackets 20 and 30 are in contact with wall surface WS and window frame WF. Similarly, right plug 260 preferably comprises stem 290 and flap 300, wherein stem 290 and flap 300 are comprised of a resilient, cushioning material having a surface suitable to augment adhesion of bracket 30, when bracket 30 is in contact with wall surface WS and window frame WF. Flap 300 of right plug 260 comprises extension member 310, and flap 302 of left plug 250 comprises extension member 312, wherein extension members 310 and 312 extend perpendicular to flaps 300 and 302, respectively. Extension members 310 and 312 lie proximate second sides 140 and 100, respectively. Extension members 310 and 312 of flaps 300 and 302, respectively, preferably serve to provide a larger surface area compared with that of contact areas or pads 340 and 342 (not shown) of plugs 250 and 260, respectively, thereby providing greater augmentation of adhesion between brackets 20, 30 and wall surface WS.

To install window cover support device 10, left plug 250 and right plug 260 are preferably inserted into left bracket 20 and right bracket 30, respectively. Stem 292 of left plug 250 and stem 290 of right plug 260 are preferably subsequently inserted into left end 42 and right end 48, respectively, of tension rod 40, replacing any existing plug therein. Tension rod 40 is preferably placed within a window frame, wherein left side 100 of left bracket 20 and right side 140 of right bracket 30 lie proximate wall surface WS. Expansion of tension rod 40 preferably forces left bracket 20 and right bracket 30 against wall surface WS, retaining left bracket 20, right bracket 30 and tension rod 40 rigidly within window frame WF.

Rotation of window cover support device 10, and the consequent drooping of curtains, is preferably prevented by placement of left bracket 20 and right bracket 30 against wall surface WS, wherein left bracket 20 and right bracket 30 extend perpendicularly around and into window frame WF. Compression of extension members 310 and 312, and flaps 300 and 302, by left bracket 20 and right bracket 30, respectively, under force of tension rod 40, preferably further assists in preventing rotation of support device 10.

Upon completion of installation, suitable curtains, valances, miniblinds and/or shades are preferably subsequently installed upon window cover support device 10 via suitable curtain rods or via integral supporting rods. If shades are preferred, shades (not shown) are inserted into, and supported by, buttons 210 and 220. If miniblinds MB are preferred, miniblinds MB are inserted into boxes 170 and 180 and supported and retained thereby via plates 190 and 200. Curtains C and valance V are carried by curtain rod CR and valance rod VR, respectively.

In an alternate embodiment of the present invention, brackets 20 and 30 could be integrally formed at ends 42 and 48 of tension rod 40.

In another alternate embodiment of the present invention, brackets 20 and 30 could include alternate devices for installation of curtains and/or valances instead of hooks 320 and 330, such as outward extensions with semicircular supports for large round curtain rods, such as those having finials disposed at the ends thereof.

In yet another embodiment of the present invention, it is envisioned that brackets 20 and 30, boxes 170 and 180, plates 190 and 200, and buttons 210 and 220 could be integrally formed.

In still a further alternate embodiment of the present invention, it is envisioned that other types of rods other than tension rod 40, could be utilized.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A window cover support rod bracket comprising:

a first flange and a second flange, wherein said second flange comprises a hole that receives a plug, said window cover support rod bracket further comprising a support box for a miniblind assembly and a support button for a shade assembly.

2. The window cover support rod bracket of claim 1, wherein said plug further comprises a flap.

3. The window cover support rod bracket of claim 2, wherein said flap further comprises an extension member.

4. The window cover support rod bracket of claim 1, further comprising support hooks for at least one window covering rod.

5. A nonrotating window cover support rod comprising:

a left bracket, wherein said left bracket comprises a plug with a flap;

a right bracket, wherein said right bracket comprises a plug with a flap, wherein said left and right brackets further comprise circular support button having slots therein for receipt of a shade assembly; and a tension rod connected to said plugs.

6. The nonrotating window cover support rod of claim 5, wherein said left and right brackets further comprise support boxes for a miniblind assembly.

7. The nonrotating window cover support rod of claim 5, wherein said left and right brackets further comprise support hooks for at least one curtain rod.

8. The non-rotating window cover support rod of claim 7, wherein said at least one curtain rod comprises a valance rod.

9. The non-rotating window cover support rod of claim 5, wherein said plugs further comprise pads.

10. The nonrotating window cover support rod of claim 5, wherein said flaps further comprise extension members.

11. A method of supporting window coverings comprising the steps of;

a) obtaining a window covering support device having a left bracket, a right bracket, a means for supporting window coverings, and a tension rod, wherein said left bracket and said right bracket further comprise plugs with flaps;

b) inserting said plugs into said tension rod;

c) placing said left bracket and said right bracket against a wall surface and a window frame and extending said tension rod; and d) attaching at least one window covering to said means for supporting window coverings.

12. The method of claim 11, further comprising the step of:

e) installing additional window coverings to said means for supporting window coverings.

13. The method of claim 11, wherein the at least one window covering and the additional window coverings are selected from the group consisting of curtains, valance curtains, miniblinds and shades.

14. The method of claim 11, wherein said left and right brackets comprise angled brackets having throughholes adapted to receive said plugs therethrough.

15. The method of claim 14, wherein said plugs have flaps thereon, and wherein said plugs are inserted through said throughholes.

16. The method of claim 15, wherein said angled brackets each comprise an interior side, and wherein said flaps lie proximate said interior side of each of said angled brackets.

17. The method of claim 11, wherein said flaps further comprise extension members.

* * * * *